United States Patent [19]

Flubacker

[11] 4,225,056

[45] Sep. 30, 1980

[54] COMPUTERIZED VENDING MACHINE

[75] Inventor: Charles H. Flubacker, Rosemont, Ill.

[73] Assignee: Artag Plastics Corporation, Rosemont, Ill.

[21] Appl. No.: 946,633

[22] Filed: Sep. 28, 1978

[51] Int. Cl.[3] ..... G07F 11/16

[52] U.S. Cl. ..... 221/2; 221/301; 194/1 N; 194/2; 116/203; 340/568

[58] Field of Search ..... 221/2, 9, 289, 299, 221/301, 312 R, 312 A; 194/1 N, 2, 10; 116/203; 340/568

[56] References Cited

U.S. PATENT DOCUMENTS

| | | | |
|---|---|---|---|
| 3,692,211 | 9/1972 | Flubacker | 221/9 |
| 3,727,869 | 4/1973 | Flubacker | 248/339 |
| 3,762,602 | 10/1973 | Wasil | 221/312 C X |
| 3,814,284 | 6/1974 | Flubacker | 221/301 |
| 4,034,839 | 7/1977 | Lee | 194/10 |
| 4,143,749 | 3/1979 | Otten | 194/1 N |

*Primary Examiner*—Joseph J. Rolla

*Attorney, Agent, or Firm*—Hill, Van Santen, Steadman, Chiara & Simpson

[57] ABSTRACT

A computerized vending machine for dispensing a large number of varied products has a frame wherein is housed a plurality of dispensing racks each of which is loaded with a product. Each of the dispensing racks has a dispensing mechanism. A coin sensing mechanism senses the coins deposited by a purchaser to pay for a desired product. A keyboard enables a purchaser to select a specific product. A microcomputer connected to the keyboard and the coin sensing mechanism compares the price of the selected product with the accumulated credit which the purchaser has established. An output buffer settable by the control computer controls the actuation of a solenoid associated with the dispensing mechanism of each member of the plurality of trays. The solenoid rotates a mechanical dispenser which permits one of a selected product to be dispensed to the purchaser. A transducer in the cabinet of the vending machine senses the delivery of a selected product and provides a feed-back signal to the control computer. In the absence of a feed-back signal, the coinage in the coin sensing mechanism is returned to the purchaser.

16 Claims, 16 Drawing Figures

( ): REFERS TO ADDRESS ASSIGNMENT

TO FIG. 4b

FROM FIG 6

PRODUCT DISPENSING SOLENOID MATRIX

COMPUTERIZED VENDING MACHINE

BACKGROUND OF THE INVENTION

1. Field of the Invention

This invention is in the field of vending machines designed to make available for purchase a large number of different products.

2. The Prior Art

Vending machines for dispensing large numbers of products are known. One such example is the subject of U.S. Pat. No. 3,692,211. Included in such machines are dispensing mechanisms for dispensing one product at a time of a type disclosed in U.S. Pat. No. 3,727,869.

There has been a need, however, for an improved vending machine whose control mechanism might be readily revised and changed as merchandising needs change. Further, it would be desirable to minimize the maintenance required for such machines by reducing or eliminating to as great an extent possible any electromechanical control devices.

SUMMARY OF THE INVENTION

A computerized vending machine has a supporting frame wherein is housed a plurality of product dispensing trays. Each product dispensing tray has a product dispensing mechanism including a solenoid and a product dispenser capable of limited rotary motion under the control of the solenoid. The product dispenser has an actuating arm, a tubular central member, a first planar member and a second elongated member slightly offset from the first member. A reinforcing bracket is positioned between the first planar member and a shaft upon which the dispensing mechanism rotates. The product dispensing solenoids are connected together so as to form a matrix. Selection of a specific solenoid associated with a desired product is accomplished by selecting a row and a column of the solenoid matrix.

A display case is positioned upon the top of the vending machine frame and contains therein the product assortment which may be purchased through the vending machine. A keyboard, a coin slot, a coin return button and a visual credit read out are all also available on the top of the vending machine frame.

Internally the vending machine includes a coin sensing mechanism, a coin box, an electronic control unit and a product delivery transducer. The product delivery transducer, or microphone, is affixed to a product delivery plate mounted within the frame of the vending machine and at an angle with respect to a vertical plane. The purpose of the product delivery plate is to deflect a vended product from within the machine toward a product dispensing aperture through which a purchaser may reach to obtain the released product. The transducer affixed to the product delivery plate senses the impact of a vended product against the product delivery plate thereby providing an electrical signal to the control unit that the vending cycle has been completed.

The control unit includes a microcomputer connected to programmable read-only memory and random access memory. The control program is stored in the programmable read-only memory. Coins deposited in the coin slot by the purchaser are sensed by the coin sensing mechanism which signals the electrical control unit of the denomination of coins which are being deposited. The electrical control unit keeps a current accumulated count of the coins which have been deposited during the current vending cycle. Electrical interface circuitry permits the central processing unit to communicate with and receive signals from the keyboard so that the key depression, indicating a selected product may be detected. Once a key depression has been detected, a prestored price associated with that selected product is retrieved from price selection circuitry. The price selection circuitry has provisions whereby a plurality of manually settable prices may be associated with the plurality of products to be vended.

The control computer then compares the current coinage credit with the prestored product price. If the current coinage credit and the prestored product price are equal, a row and a column designation for the selected product is supplied to a row select register and a column select register. Outputs from the row select register and the column select register energize row select and column select reed relays which select a row and a column of the product dispensing solenoid matrix. A signal is subsequently sent to a common relay control register which provides power to the selected solenoid so that it may actuate the dispensing mechanism thereby releasing a product from the adjacent support rail of the product dispensing rack.

The control computer then waits for a predetermined time to see if a signal is returned from the transducer, or microphone, in the product delivery plate of the vending machine cabinet indicating that a product has been released and delivered to the purchaser. If a signal is not returned from the product dispensing transducer, within the predetermined time, it is assumed that the product dispensing tray is empty. The processer generates a signal through an accept and return register to energize a return reed relay which in turn energizes a return solenoid in the coin sensing mechanism thereby returning the accumulated coinage from the escrow in the coin sensing mechanism to the purchaser. If a signal is detected from the product delivery transducer, a signal is sent to the accept and return register to energize the accept reed relay which in turn energizes the accept solenoid in the coin sensing mechanism transferring the coinage from escrow into the coin box.

During the time the coinage is being deposited, the current accumulated credit is displayed on a display device available for viewing by the purchaser.

The price selection circuitry has an input port that can receive a unique indicia or bit pattern for a selected product. The bit pattern or indicia is sensed by a decoder circuit and a signal is generated on one of 42 lines within the price selection circuitry. The 42 lines are connected to a set of 12 price selection switches. Forty-two products are thereby compressed to 12 prices. The selected one of 42 lines enables one of 12 price selection switches thereby providing a price for the selected product through an output buffer to the control computer for comparison purposes.

DETAILED DESCRIPTION OF THE PREFERRED EMBODIMENT

Figure 1:
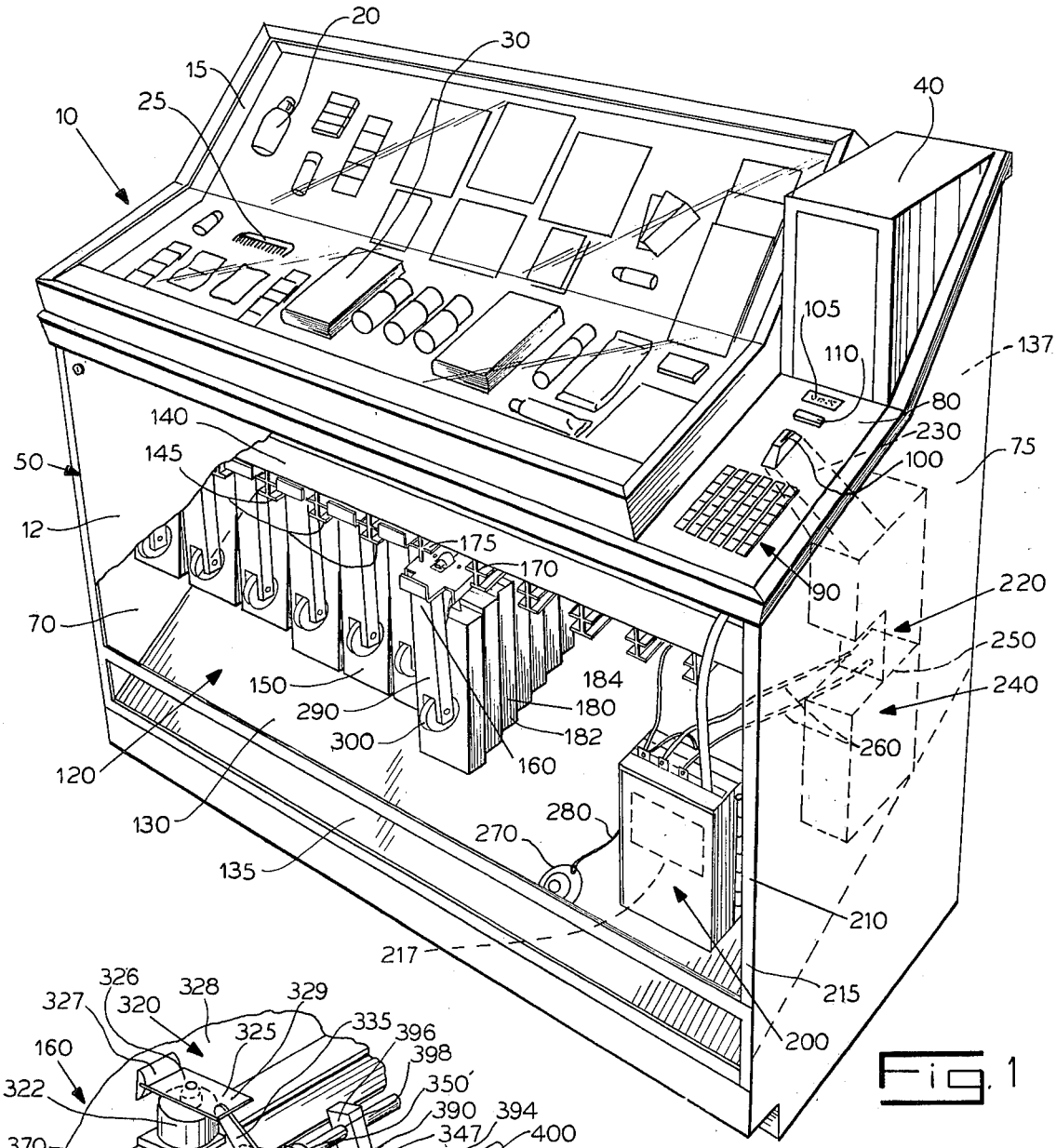
FIG. 1 is a perspective view with a partially broken away front cover of the vending machine.

While the principles of the present invention find a particular utility in a computerized vending machine, it will be understood that the vending machine arrangement of the present invention may be utilized in other combinations. By way of exemplary disclosure of the best mode of practicing the invention there is shown generally in FIG. 1 a view of a computerized vending machine 10 with a front cover 12 broken away. The vending machine 10 is useful for vending a large assortment of products. The products are displayed in a top display panel 15 of the vending machine 10. Typical articles are of a type that might normally be bought through a drug store such as a bottle of medication 20, a comb 25, and a book 30. Optionally, a stamp dispenser 40 may be included as a feature of the computerized vending machine 10. The machine 10 is supported by a frame 50. The sheet metal front panel 12, and a set of sheet metal side panels 70, and 75 are fastened to the frame 50 by any conventional means. Adjacent to the display case 15 is a service panel 80. The service panel 80 includes a keyboard 90, a coin slot 100, a numeric read-out 105 and a coin return button 110.

The vending machine 10 has an interior region 120 bounded by the display case 15, the side panels 70 and 75, a slanting sheet metal product delivery panel 130, with an associated product access slot 135, and a rear panel 137. Within the volume 120 is contained a set of dispensing racks 140 containing merchandise to the dispensed of which a typical element is a piece of merchandise 150. The elements of merchandise such as the typical element 150 may be of various sizes depending on the items stored therein. The racks 140 are each supported on the frame 50 by a set of rails identified as group element 145. A rack 160 is shown in a partially installed position. The rack 160 is installed in the volume 120 by sliding it along a set of support members 170 and 175. At the time the rack 160 is installed in the machine it has been previously loaded with a set of products 180. The products 180 are each contained within a delivery container 182 of a conventional type which is supported on the rack 160 by a hook 184 also of a conventional type. The number of racks included in the group 140 is arbitrary depending on the general size of the region 120.

A frame 200 which is pivotably mounted on a hinge 210 affixed to an end 215 of the frame 50 contains an electronic control unit 217. A coin sensing mechanism 220 of a conventional type is connected by a coin chute 230 to the coin slot 100. A coin box 240 which receives coins from the coin sensing unit 220 in response to a product such as the product 150 having been delivered is mechanically affixed to a lower side 250 of the coin sensor 220. The coin sensor 220 is connected via a group of cables 260 to the electronic control unit 217.

The coin sensing mechanism 220 includes well known means for sensing different denominations of coins such as 5¢, 10¢ or 25¢. The coin unit 220 also includes an escrow which can temporarily retain a group of deposited coins. Upon receipt of an external signal, the coin sensor 220 can direct the coins in escrow to the product access slot 135 or to the coin box 240.

A sensor, or transducer, 270 affixed to the sheet metal plate 130 detects the delivery of a product such as the product 150 by sensing the product 150 impacting against the sheet metal plate 130. The transducer 270 is connected by a cable 280 to the electronic control unit 217 and provides a feedback means so that the delivery of a product may be varified by the control unit 217. The transducer 270 may be a microphone or a loudspeaker used as a sensor device.

At the front of each of the dispensing trays 140 such as the dispensing tray 160 is an arm 290 with a roller 300 affixed thereto. The purpose of the arm 290 and roller 300 is to maintain the products such as the product 150 at substantially a vertical orientation for better and more reliable vending.

Figure 2:
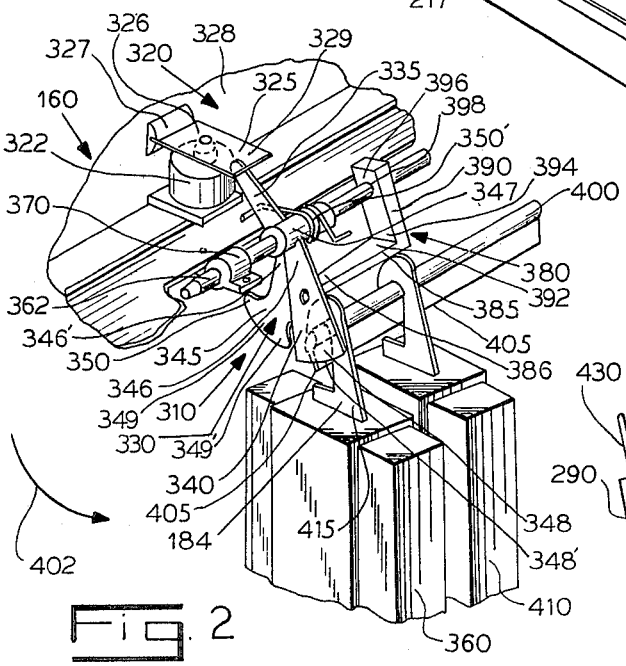
FIG. 2 is an enlarged, perspective, partial view of a dispensing rack and associated dispensing mechanism.

A dispensing mechanism 310 which is used with each of the dispensing trays 140 is shown in FIG. 2. The dispensing mechanism 310 is affixed to the tray 160. The dispensing mechanism has a solenoid 320. The solenoid 320 has a coil 322 and a leaf spring 325. The spring 325 has a first end 326 connected fixedly to a bracket 327 which is connected to a surface 328 of the dispensing tray 160. A bifurcated dispenser 330 has an actuating arm 335 which is activated by the coil 322 being energized and attracting the leaf spring 325. A second end 329 of the leaf spring 325 depresses the arm 335. The dispenser 330 has, in addition, a first 340 and a second 345 elongated member each of which is separated from one another longitudinally, and each of which is at an angle with respect to one another and both of which are affixed at a first end 346, 346' to an elongated central member 347 to which is also affixed the actuating arm 335. The member 340 has a second end 348 which is somewhat wider than the first end 346 and which ends in a curved surface 348'. The member 345 has a second end 349 with a first and a second extension 349', 350 thereon.

A spring 350' biases the dispensing mechanism 310 so as to not release a product such as a product 360 unless the coil 322 is attracting the leaf spring 325 thereby rotating the central member 347. Simultaneously, the two elongated members 340 and 345 are also rotated. The tubular, central, member 347 is supported by a shaft 362 which rotates in a bushing A reinforcing bracket 380 has a first member 385 which is affixed to the elongated member 340 of the dispensing mechanism 310 at a first end 386 and joins a second member 390 perpendicular to the first member 385. A second end 392 of the member 385 is connected to a first end 394 of the member 390. The member 390 has a second end 396 with a boring 398 therethrough. The shaft 362 is received through the boring 398. The purpose of the bracket 380 is to increase the strength of the planar member 340 so that it is not broken off by the force exerted by the packages such as the package 360 which is supported by the hook 184 on an inclined rail 400. The package 360 slides along the rail 400 due to the force of gravity.

When the coil 322 is energized the dispensing mechanism 310 is caused to rotate in a direction 402 by the movement of the leaf spring 325 against the arm 335 so that the planar member 340 moves away from a front end 405 of the supporting rail 400 thereby permitting the product 360 to fall free and be delivered to the customer through the product delivery slot 135. A second product 410 immediately behind the product 360 is blocked by the movement of the member 345 in front thereof in conjunction with the movement of the member 340 away from the end 405 of the rail 400 which supports the product 360.

Figure 3:
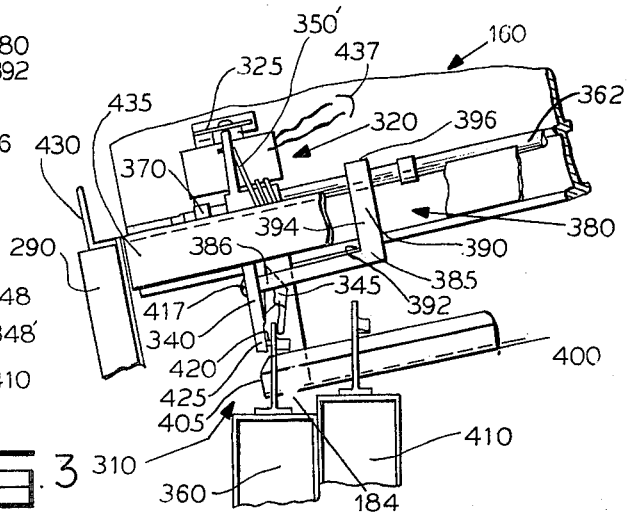
FIG. 3 is a side elevation of the dispensing rack and mechanism of FIG. 2.

FIG. 3 a side view of the dispensing mechanism of FIG. 2 shows the first member 340 offset from the second member 345 in order that as the dispensing mechanism 310 rotates under the effect of the coil 322 only the first product 360 will be permitted to drop off the end 405 of the dispensing rail 400. The second product 410 and subsequent products behind the product 410 will be restrained by the member 345. The bracket 380 is shown attached to the member 340 by an attaching screw 417. A ridge 420 is located near an end 425 of the planar member 340 so that only the ridge 420 contacts the retaining hook 184 of the product 360. A lip 430 is shown affixed to a front end 435 of the tray 160 for pulling tray 160 forward out of the machine for replacement and reloading purposes. A pair of connecting wires 437 provides a means whereby electrical energy may be supplied to the coil 320 thereby energizing it and permitting it to attract the leaf spring 325 and rotate the dispensing mechanism 310.

Figure 4A:
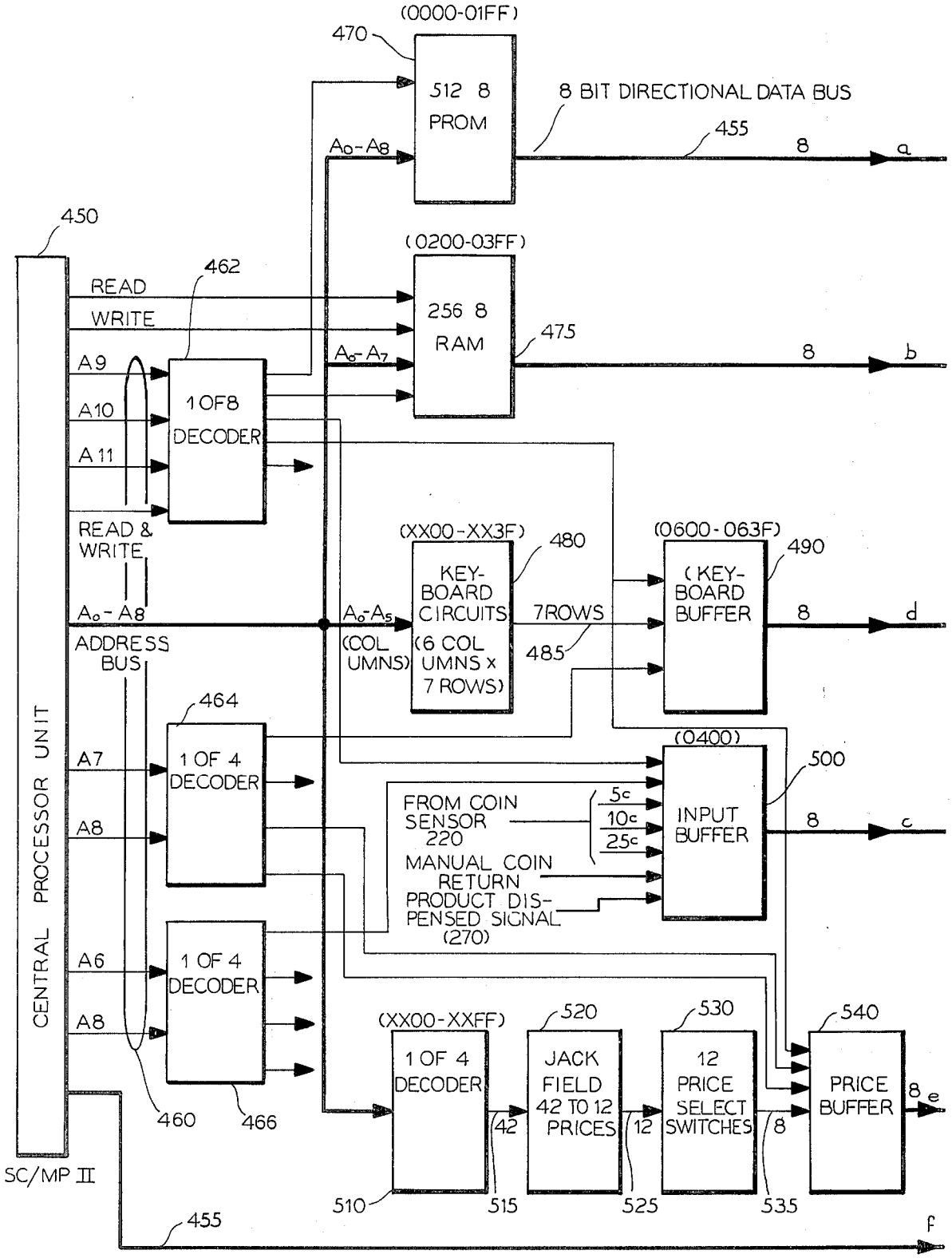
FIGS. 4*a* and 4*b* comprise a block diagram of the control system of the present vending machine.

FIG. 4 is a block diagram of the control unit 217 of the present invention. FIG. 4*a* discloses a central processing unit 450 which has an 8-bit bidirectional data bus 455 and an address bus 460. A set of three decoders 462, 464, and 466 is connected to various signals of the address bus 460 for decoding purposes. The processor 450 is designed to access 16 groups of 4,096 bytes of memory. The example system of FIG. 4 is designed to use the first group of 4,096 bytes. Decoder 462 subdivides this group of bytes into 8 groups of 512 bytes each. Decoder 464 further sub-divides each of the 8 groups into 4 groups of 128 bytes each. Decoder 466 sub-divides each of the 4 groups of 128 bytes into 4 groups of 32 bytes each. The outputs of the decoders 462 through 466 are then used to assign unique addresses to each of the input, output devices associated with the control of the vending machine. For example, the third group of 512 bytes, $512_3$, is "anded" with the first group of 32 bytes, $32_1$ to assign, address 0400 to input buffer 500.

It is a design feature of the central processing unit 400 that all input output devices are accessed essentially as memory locations. Hence, each input output device has assigned to it an address which also might be assigned to a memory location. These respective addresses appear in FIG. 4 in parenthesis. A 512-byte programmable read-only memory (PROM) 470 and a 256-byte random access memory 475 are each connected to address bus 460 and to the 8-bit bidirectional data bus 455. A set of control sequences is permanently stored in the programmable read-only memory (PROM) 470 and transient data are stored in the random access memory 475 during a vending cycle. The keyboard 90, composed of 6 columns by 7 rows, has an input circuit 480 which is interfaced to selective signals from the address bus 460. Outputs from the keyboard 90 are scanned sequentially on a column basis and a set of signals representing seven rows for the present column appears on a set of lines 485 which form the inputs to buffer 490. The outputs from the buffer 490 is also connected to selected signals of decoder 462 and 464 for addressing purposes. A second buffer 500 is connected to the coin sensor 220, to the manual coin return button 110 and to the product dispense transducer 270. The outputs from the buffer 500 are connected to the 8-bit bidirectional data bus 455.

For storing a set of preselected product prices, a one of 42 decoder 510 is connected to selected signals from the address bus 460. The output on the one to 42 decoder 510, on a set of lines 515, is connected as a set of inputs to a jack adjustable compression matrix 520 which compresses 42 potential prices to 12 prices. A 12-line output 525 from the 42 to 12 compression matrix 520 enables one of 12 price select switches 530. A selected one of the 12 price select switches 530 is read out on a set of lines 535 to a third buffer 540. The output of the price buffer 540 is connected to the 8-bit bidirectional data bus 455.

By way of example and not by way of limitation, the central processor unit in a practical implementation of the inventive vending machine is a National Semiconductor ISP-8A/500D microprocessor (SC/MP 11). The decoders 462, 464, and 466 may be any electronically compatable integrated circuit. The programmable read-only memory 470 and the random access memory 475 may also be any compatable electronic memory units. The buffers 490, 500 and 540 may be any compatable electronic buffer units.

Figure 4B:
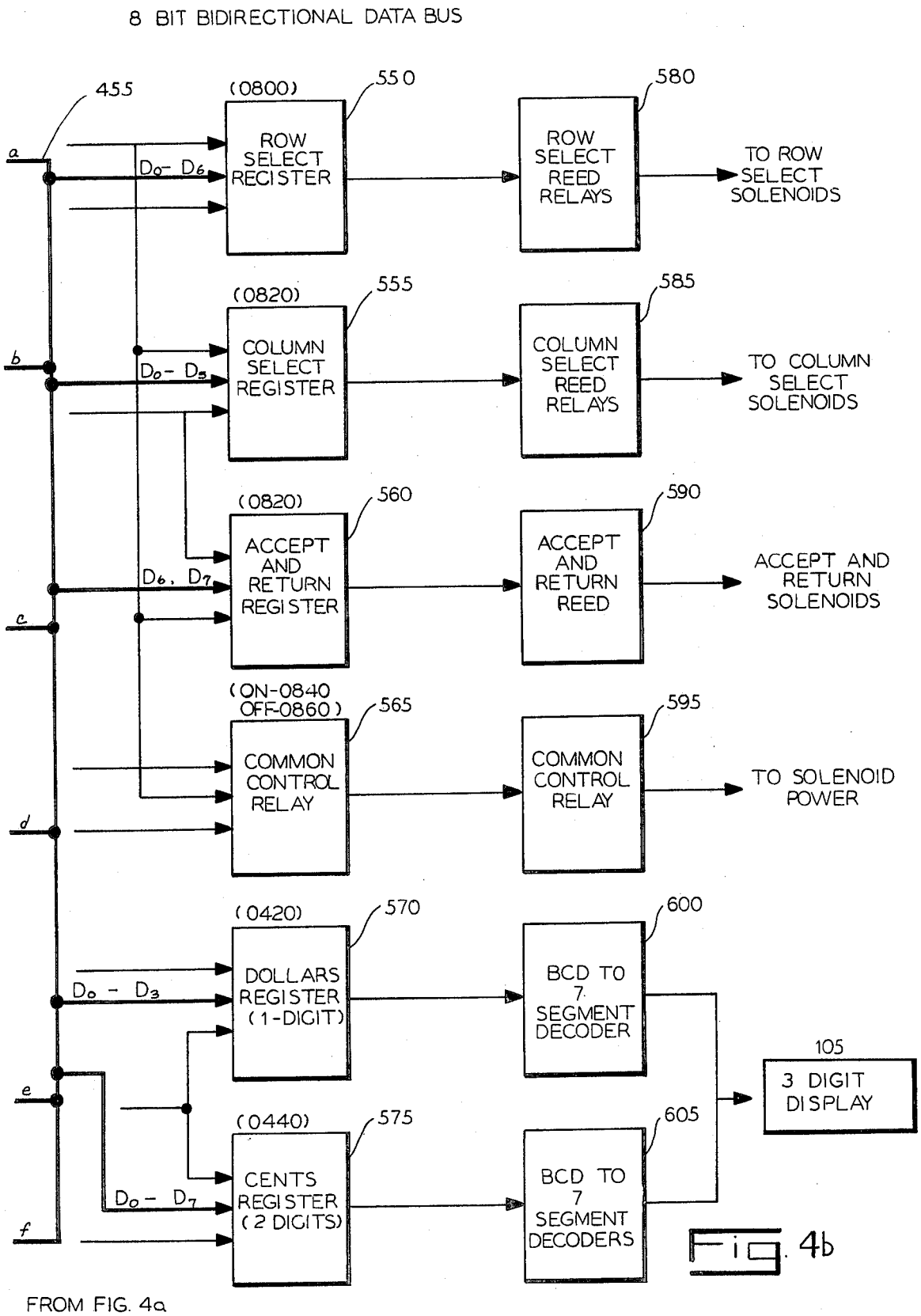

FIG. 4*b*, an extension to FIG. 4*a* discloses the structure of the output circuitry. A set of output registers 550, 555 560, 565 570 and 575 are connected selected bits of the 8-bit bidirectional data bus 455. The outputs of the row select register 550, column select register 555, accept and return register 560 and common control relay register 565 are connected to a set of reed relays 580, 585, 590 and 595. The outputs of the dollars register 570 and cents register 575 are connected to a set of binary coded decimal (BCD) to 7-segment decoders 600, 605. The outputs of the BCD to 7-segment decoders 600, 605 are connected to the three-digit display 105 on the top service panel 80 of the vending machine 10. The outputs of the row select reed relays 580, column select reed relays 585, accept and return reed relays 590 and common control relay 595 are all connected to power solenoids.

Figure 5A:
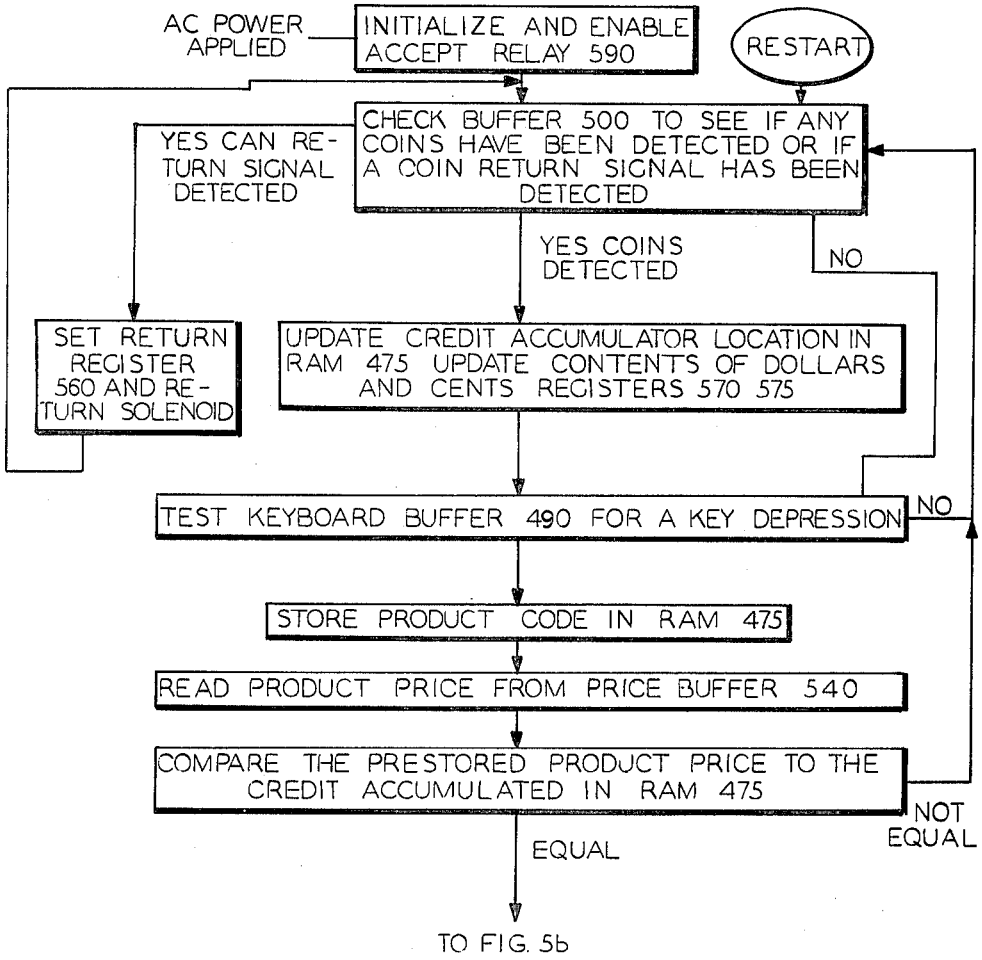
FIGS. 5*a* and 5*b* comprise a flow chart showing a sequence of operations during a vending cycle.
Figure 5B:
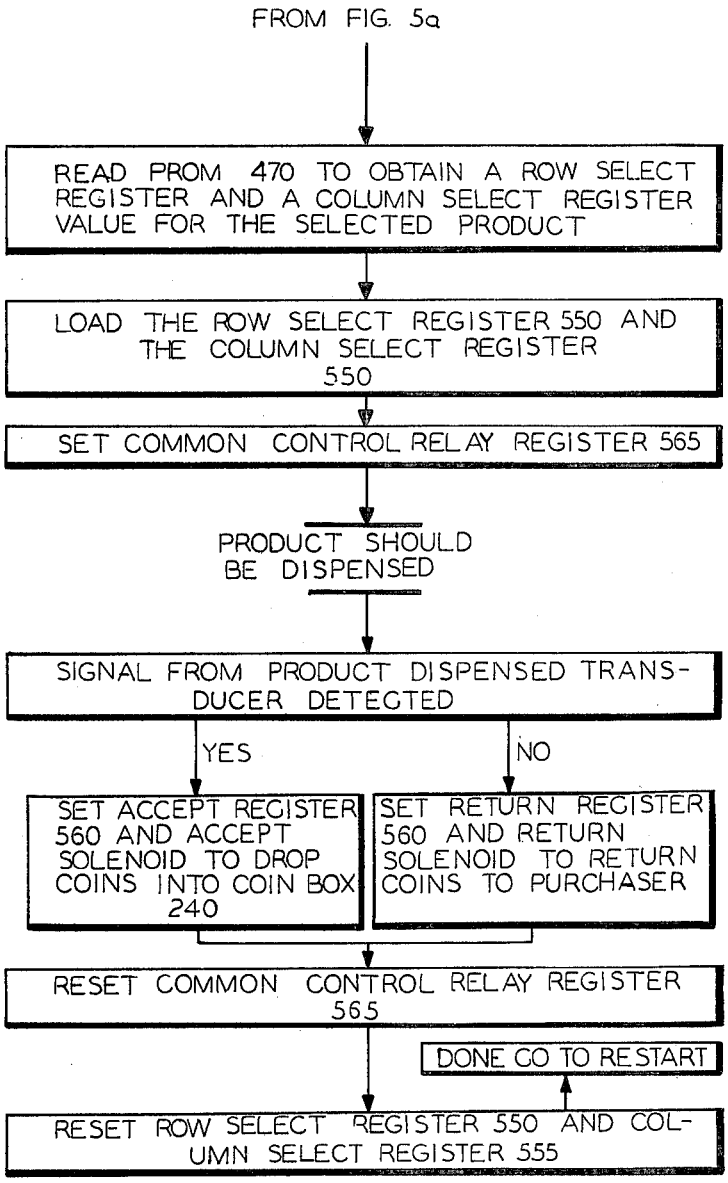

FIG. 5 is a flow diagram of a vending sequence based on the block diagram of FIG. 4. Upon initiation of power of central processing unit 450 will commence sequential reading and executing of the instructions stored in the programmable read-only memory 470. The first group of instructions will initialize the control system 217 and cause the coin accept solenoid to be energized for a period of time through the accept and return register 560. The coin accept solenoid is a part of the escrow mechanism of the coin sensing device 220. By actuating the escrow mechanism, coins which are in escrow which had been deposited in the coin slot 100 prior to the pwer having been removed will automatically be collected into the coin box 240. This is an anti-theft provision so that if an individual deposits coins through the slot 100 and then removes the a.c. power to the machine in an attempt to remove a product without having the vending machine 10 detect the vending of that particular product. Upon plugging the a.c. power back into the machine, the coins in the escrow unit of the coin sensor 220 will automatically be collected into the coin box 240 thereby depriving the unauthorized manipulator of his free product. The central processing unit 450 will then continuously interrogate buffer 500 to see if a coin has been sensed by the coin sensor 220. After a coin has been sensed, the amount of that coin 5 cents, 10 cents, or 25 cents, will be added to a coin-store location in the random access memory 475. Immediately thereafter, the value in the dollars register 570 and the cents register 575 will be updated to correspond to the newly deposited coins so that the value shown on the three-digit display 105 truely reflects the present credit.

Subsequent to the first coin being deposited, the central processing unit 450 will on a regular basis interrogate the manual coin return signal which is one of the inputs to the buffer 500 to detect whether or not the manual coin return switch 110 has been depressed by the purchaser. If the switch 110 has been depressed, and when that condition has been detected through the buffer 500, a bit is sent to the accept and return register 560 which energizes the return solenoid thereby returning the coin from the coin detection mechanism 200 to the sheet metal panel 130 where it becomes available to the purchaser at the aperture 135. If, however, instead of detecting the coin return switch 110, additional coins are deposited, the random access memory coin store in the random access memory 475 will be up-dated along with the three-digit display 105.

After depositing the required number of coins for the desired product, the purchaser will select a product by depressing a key on the keyboard 90 on the service panel 80. The central processing unit 450 will sense this condition while examining the contents of keyboard buffer 490 which has it inputs connected to the 7 rows of the 6 columns by 7 row keyboard matrix 90. The exact key which has been depressed will be detected by the central processing unit 450 and a unique code for it will be stored in random access memory 475.

The central processing unit 450 will then read the prestored price for the product corresponding to the key which has just been depressed on the keyboard 90. This price which will be available through the price buffer 540 has been established by the one of 42 decoder 510, the 42 to 12 compression matrix 520 and the 12 price select switches 530.

The central processing unit 450 will then compare the prestored price which has been read through the price buffer 540 to the credit which has been previously stored in a location in the random access memory 475. If the amount deposited is not in agreement with the price of the product selected, the key closure on the matrix 90 will be ignored and the central processing unit 450 will continue scanning the outputs from the coin sensor 220, the manual coin return 110 and the outputs from the keyboard 90.

If the product price is in agreement with the accumulated credit, the central processing unit 450 will initiate a vend cycle. Product row and column select codes are stored in the programmable read-only memory 470 for each of the 42 products. The proper codes will be accessed and then stored in the row select register 550 and in the column select register 555 which are connected to the 8-bit bidirectional data bus 455. The outputs from the row select register 550 and the column select register 555 will energize off one of the row select reed relays 580 and one of the column select relays 585 which in turn are capable of energizing the dispensing solenoid associated with the selected product. Subsequently, the processor 450 will output a signal to the common control relay register 565 which will energize the common control relay 595 which will, in turn, applies power to the selected product solenoid. At this point, the product selected by the switch matrix 90 will be dropped onto the sheet metal panel 130 if it is not sold out. The central processing unit 450 will then examine the output from the product dispensed transducer 270 to see whether or not a signal has been sensed by the input buffer 500 indicating that a product actually was dispensed.

If the transducer 270 generates a signal corresponding to a product dropping on the sheet metal plate 130, the processor 450 will energize the accept register 560 which in turn is connected to the accept relay 590 of the coin sensing mechanism 220 which then permits the escrow to deposit the credited coinage into the cash box 240. If a dispensed verification signal is not received from the transducer 270 within an alloted time period, the coin return solenoid will be energized through the return register 560 which in turn energized the return relay 590 and the return solenoid releasing the coin from the coin detect mechanism 220, bypassing the coin box 240 and returning the coinage through the aperture 135 to the customer.

In either case, a proper vending cycle or an empty tray, the common control relay register 565 will be reset which in turn will reset the common control relay 595 turning off the power solenoid. Subsequently, the row and column registers and relays 550, 555 and 580, 585 are deenergized under a no current condition. The central processing unit 450 then resets any of the random access memory locations in the random access memory 475 that need to be initialized to start the next vending cycle.

Figure 6A:
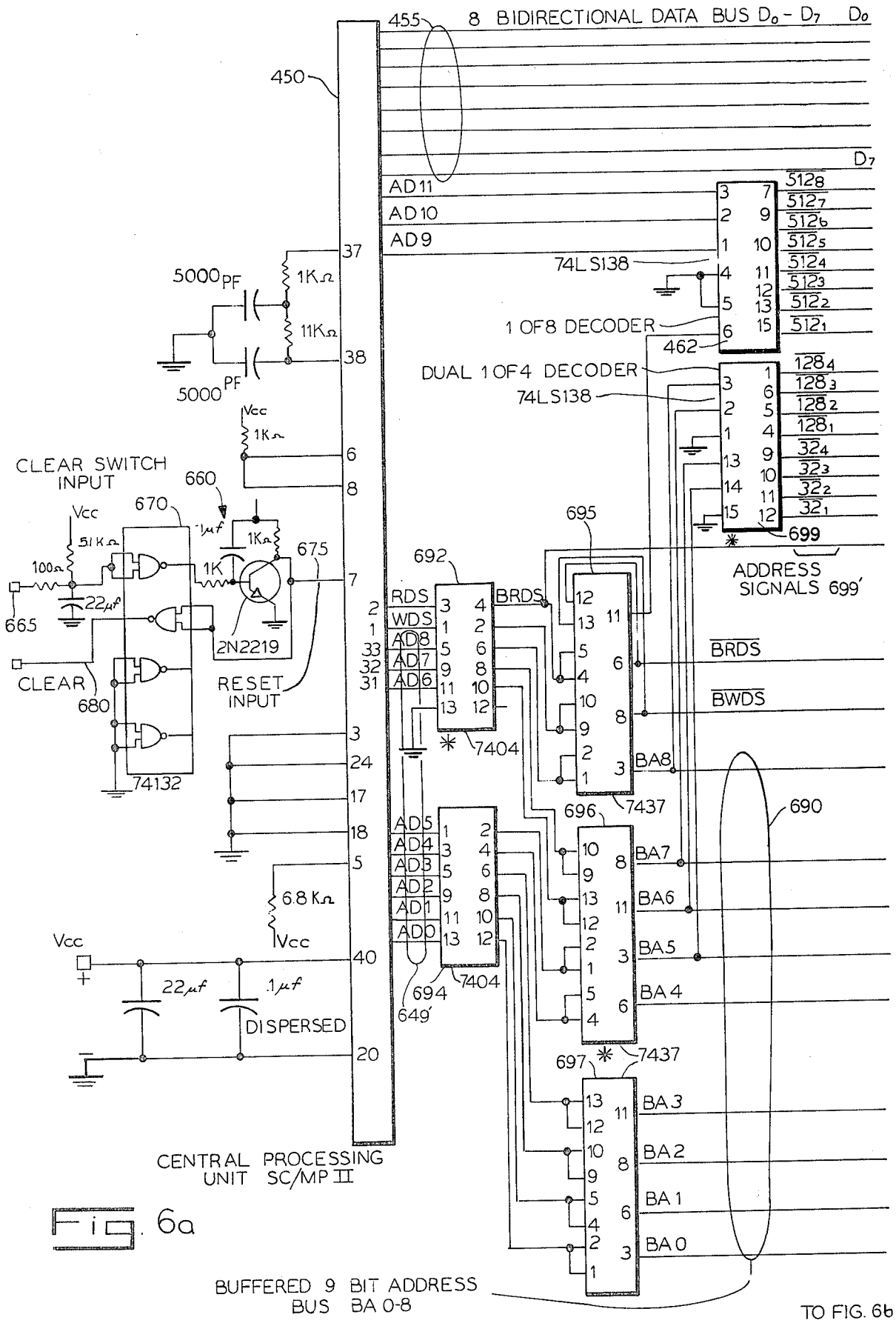
FIGS. 6a, 6b and 6c comprise a schematic diagram of the central processing unit electronic board.
Figure 6B:
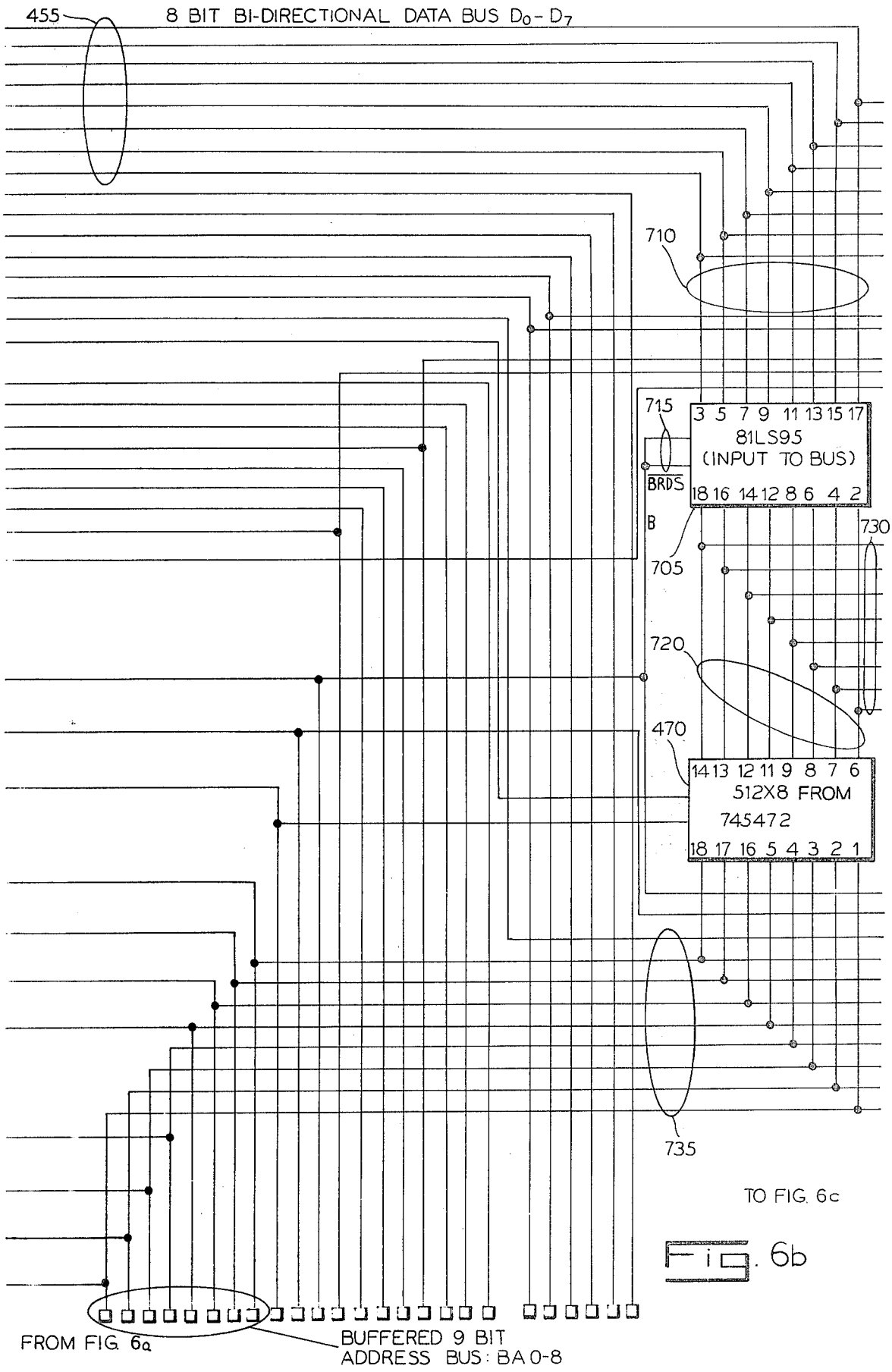

FIG. 6 is a schematic of the central processing unit electronic board. The central processing unit 450 is connected to an input circuit 660 which receives a signal from a clear switch on a line 665, which includes a Nand-Schmidt Trigger integrated circuit 670 and which generates a reset signal on a line 675 to the central processing unit 450 as well as a general system clear signal 680 for use as necessary. The one of eight decoder circuit 462 is shown again connected to address bits 9, 10, and 11 as in FIG. *4a*. A 9-bit buffer address bus 690 is created in FIG. *6a* having signal lines BAO-8. A pair of hexinverter circuits 692, 694 invert address bus bits zero thru eight 694' and provide the inverted address bus bits 0 thru 8 as inputs to three Nand-buffer circuits 695, 696, 697. The outputs of the three N and -buffer circuits 695, 696, 697 create the 9-bit buffer address bus 690. The two, one of four decoder circuits 464, 466 of FIG. *4a* are implemented in a dual one of four decoder circuit 699. The 9-bit buffered address bus 690 provides a set of four inputs to the dual one of four decoder circuit 699. A set of outputs of the two decoder circuits 699' is used to provide address signals to the memory chips 470, 475 of FIG. 4 as well as the other input and output devices 490 and 500 for example.

The 8-bit bidirectional data bus 455 having lines DO–O7 which provides the data communication path to the central processing unit 450 is drawn along the top of FIG. *6a*, the top of FIG. *6b* and across the top of FIG. *6c*. FIG. *6b* includes an 8-bit tristate buffer 705 and the 512 byte programmable read only memory 470. The outputs of the tristate buffer circuit 705, a group of 8 lines 710, are connected respectively to the 8 lines of the 8-bit bidirectional data bus 455. The tristate buffer circuit 705 is a gated buffer circuit of a conventional type whose purpose is to provide an input to the 8-bit bidirectional data bus 455 under the control of the central processing unit 450. Control by the processor 450 is achieved by a control line 715. The 512 by 8 byte PROM memory chip 470 has a set of 8 output lines 720 which are connected to an 8bit buffered data bus 730. It is the 8-bit buffered data bus 730 which provides the inputs to the tristate buffer circuit 705. The contents of the buffered bus 730 are then gated onto the 8-bit bidirectional data bus 455 under the control of central processing unit 450. Address inputs to the PROM memory chip 470 are provided by an 8-bit buffered address bus 735 which consists of eight of the nine bits of the buffered address bus 690 generated on FIG. 6*a*.

Figure 6C:
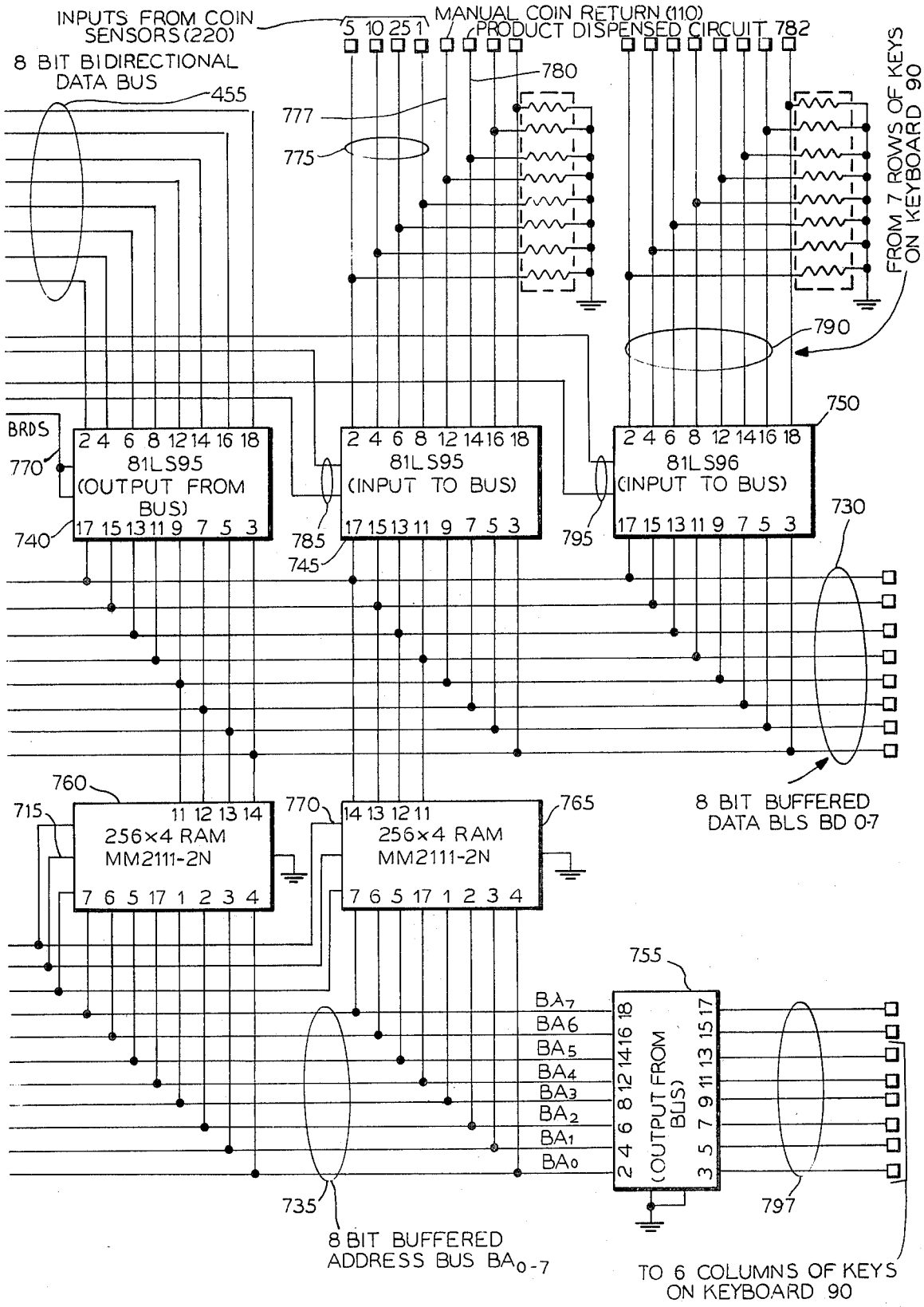

In FIG. 6*c* will be found four additional tristate buffer chips 740, 745, 750, and 755. Additionally, in FIG. 6*c* will be found two random access memory chips 760, 765. Each of the chips 760, 765 is a 256×4-bit memory. Taken together the two chips 760 and 765 correspond to the 256×8-bit RAM memory chip 475 of FIG. 4*a*. The 8-bit bidirectional data bus 455 provides a set of 8 inputs to the tristate buffer circuit 740 which are gated onto the 8-bit buffered data bus 730 under the control of central processing unit 450 through a control line 770. The second tristate buffer circuit 745 of FIG. 6*c* is an input circuit providing inputs from the coin sensor 220 on a set of lines 775, the manual coin return switch 110 on a line 777 and a product dispensed signal on a line 780 from a product dispensed circuit 782. A pair of control lines 785 controlled from the central processing unit 450 determines when the input signals to the tristate buffer chip 745 are gated onto the buffered data bus 730. The third tristate buffer circuit 750 in FIG. 6*c*, on a set of 7-input lines 790 receives inputs from each of the seven keyboard rows sequentially. A pair of control lines 795 controlled from the central processor 450 determine when each of the seven keyboard rows, available on the set of lines 790, is read onto the 8-bit buffered data bus 730. The fourth tristate buffer circuit 755 has a set of inputs consisting of the 8-bit buffered address bus 735 and a set of outputs 797 which are connected to the 6 columns on the keyboard 90. The signals generated in FIG. 6, the central processing unit board are also made available to other boards as necessary.

Figure 7A:
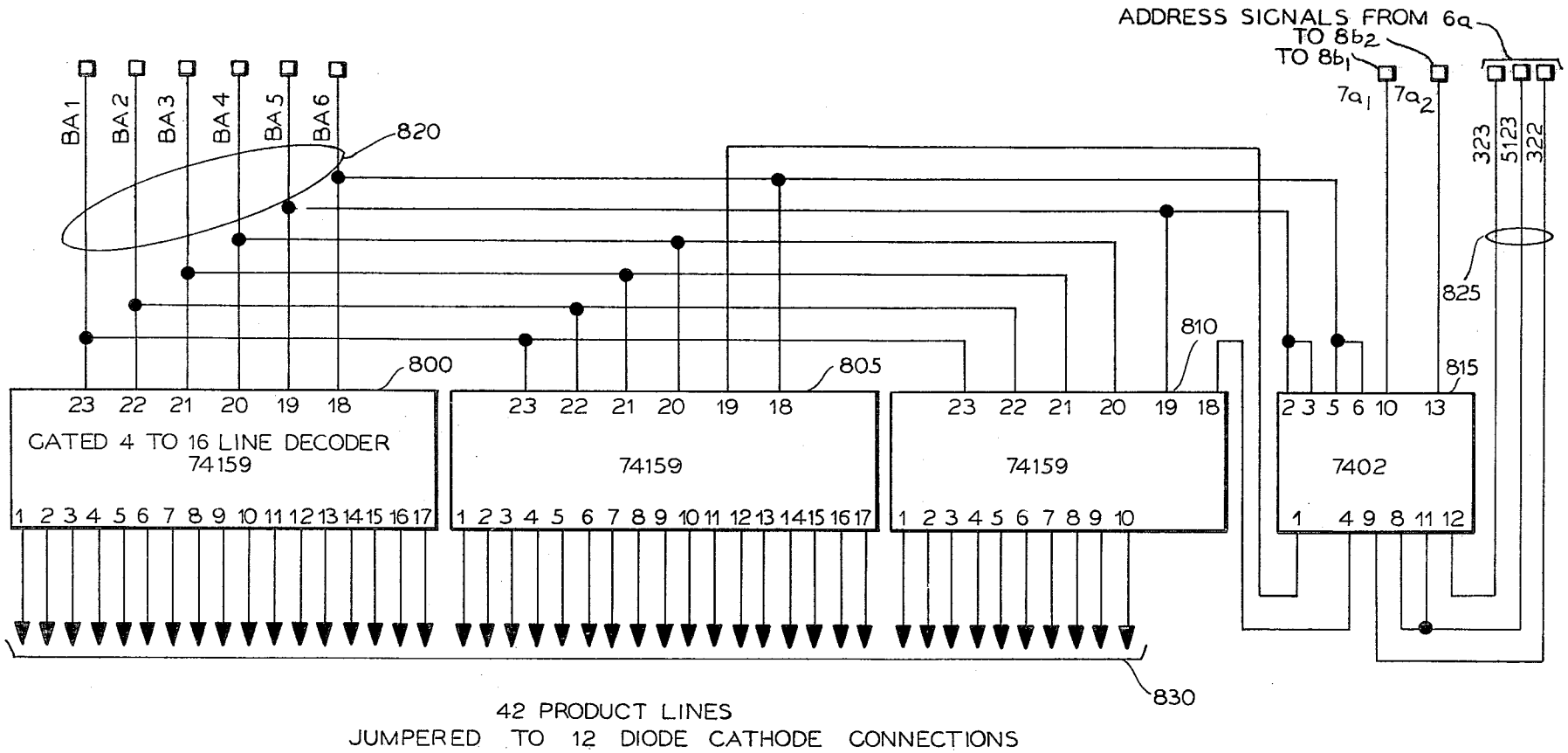
FIGS. 7a, 7b, and 7c comprise a schematic diagram of the pricing board.
Figure 7B:
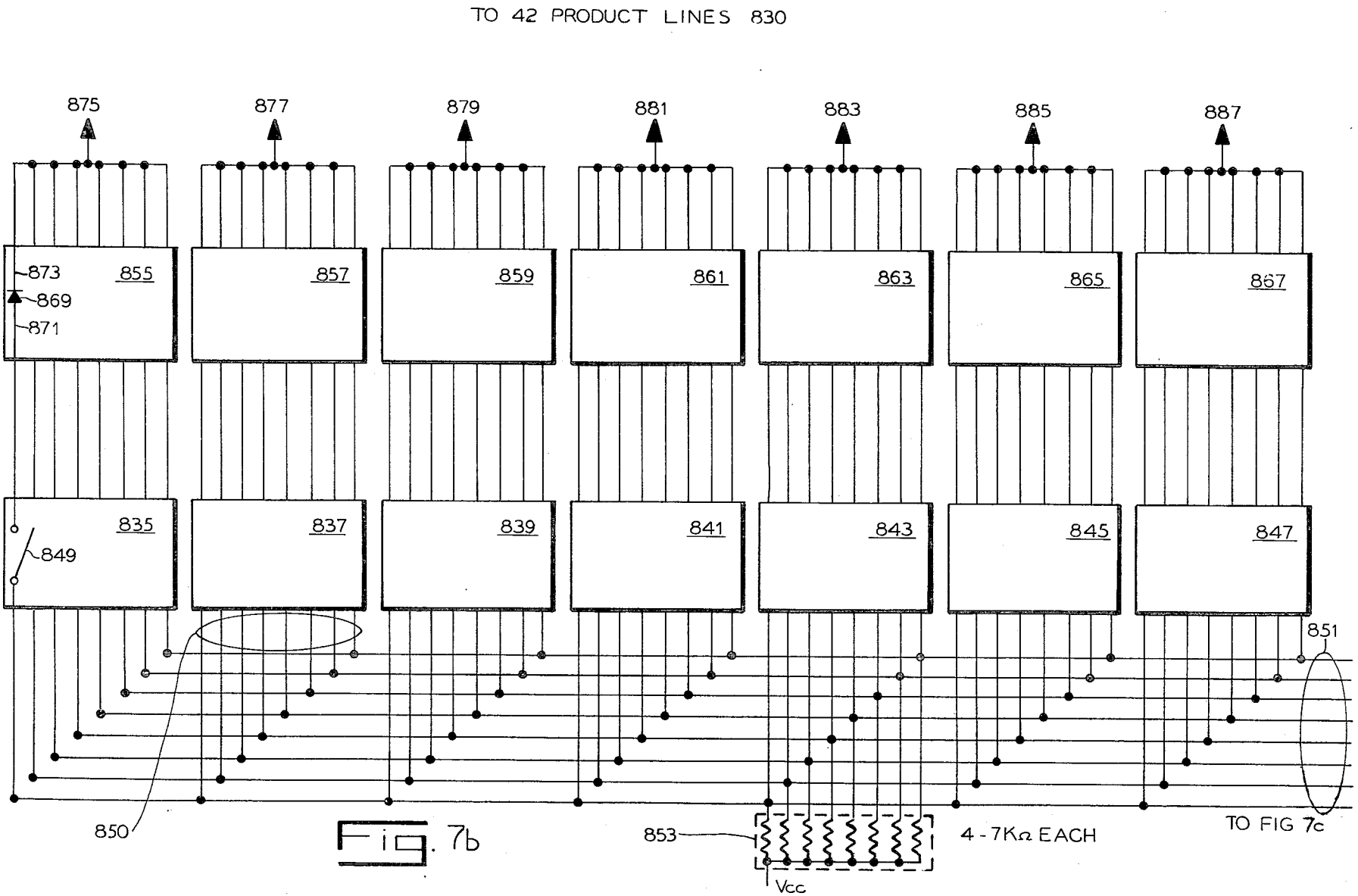
Figure 7C:
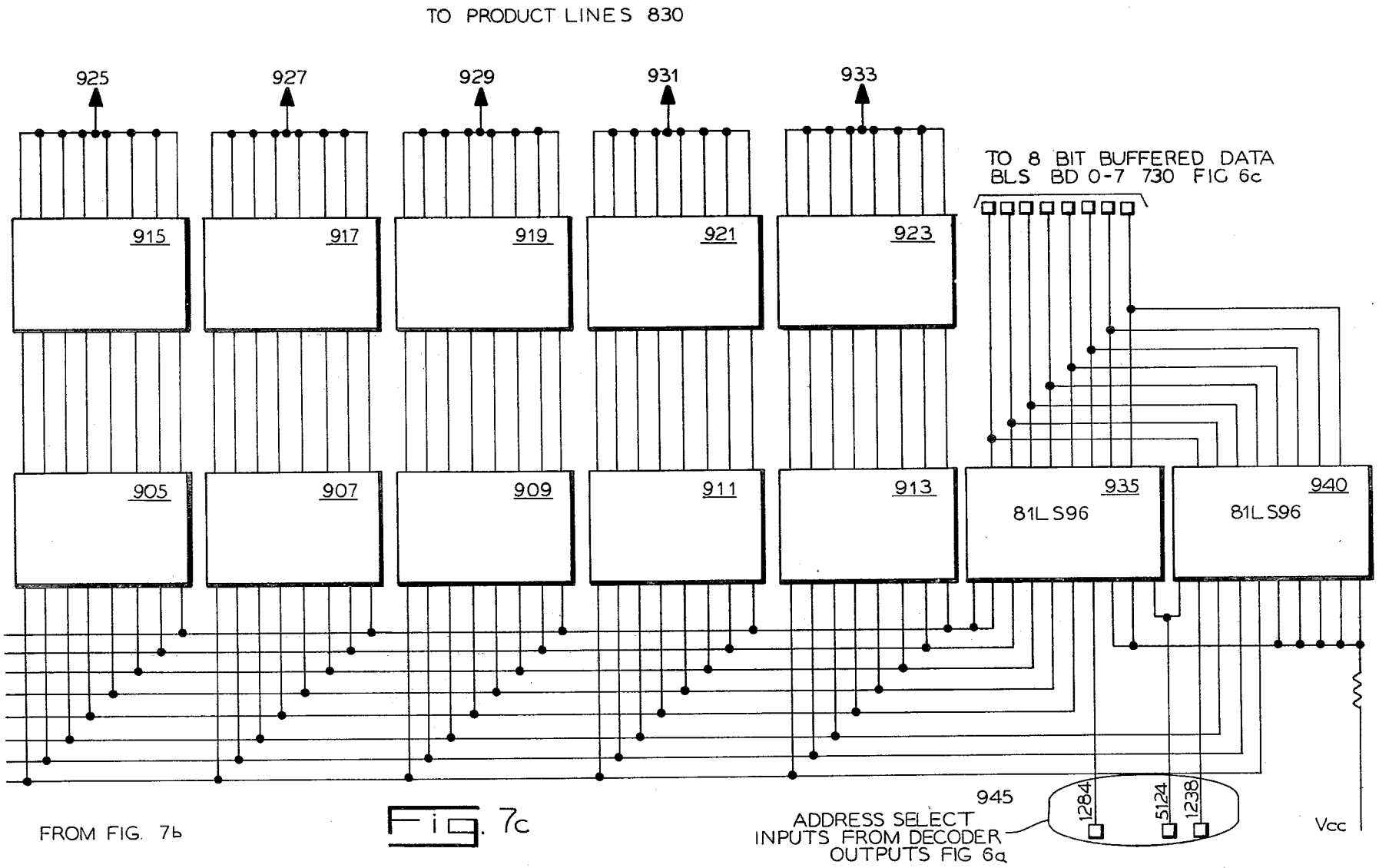

FIG. 7 is a schematic of the pricing circuitry. In FIG. 4 the pricing circuitry is represented by element 510 a one of 42 decoder circuit, element 520 a manually setable jack field 520 which compresses 42 selected product signals to one of 12 prices, a set of twelve price select switches 530 and a price buffer 540. FIG. 7*a*, corresponds to the one of 42 decoder 510. A set of three gated 4 to 16 line decoders 800, 805, and 810 are interconnected with a quad NOR-gate chip 815. A first set of inputs to the decoder of FIG. 7 is a set of six bits 820 of the buffered address bus 690. A second set of inputs to the decoder of FIG. 7*a* is a set of three address lines 825 selected from the set of address signals 699' of FIG. 6*a*. The outputs of the three gated 4 to 16 line decoders 800, 805 and 810 represent a series of 42 individual lines, one corresponding to each product, 830. It should be noted, that the gated 4 to 16 line decoders 800, 805, 810 have open collector outputs so that any of the lines 830 may be connected together without damaging the circuitry of the generating chips. The outputs 830 of the 4 to 16 line decoders 800, 805, 810 are selectively connected to a set of inputs of FIGS. 7*b* and 7*c* by means of a conventional manually connectable set of jacks and jumper wires.

FIG. 7*b*, corresponding in part to the twelve price select switches 530 of FIG. 4*a* has a set of seven modules 835, 837, 839, 841, 843, 845 and 847. Each of the seven modules 835–847 contains a set of eight individual switches of which a switch 849 in module 835 is representative. The switch 849 is a simple single-pole single-throw slide switch. Each of the modules 835 through 847 represents a price setting module with which a price may be specified for a given product. A price is specified by setting the switches such as the switch 849 in a given module to an open or a closed condition. The modules 835 through 847 each have a set of eight outputs such as a set of outputs 850 of the module 837 which are wired in parallel to form an eight-bit price select bus 851. Connected to the eight-bit parallel price select bus 851 is a set of eight pull-up resistors 853 which each have one end connected in common to a system power supply.

Connected to each of the modules 835 through 847 is a diode module 855, 857, 859, 861, 863, 865, 867. Each of the modules 855 through 867 contains a set of eight signal diodes of which a diode 869 is typical. The diodes in the modules 855 through 867 are all connected as is the diode 869 so a discussion of it will suffice for the rest of the diodes. The diode 869 has an anode 871 and a cathode 873. The cathode 873 is connected in common with the cathodes of the other seven diodes in the module 855 and brought out to a point 875. The anode of the diode 871 is connected to one side of the switch 849. The anodes of the remaining 7 diodes in the module 855 are each connected to a corresponding switch in the module 835.

Each of the modules 855 through 867 has a connection corresponding to the common diode connection 875 of the module 855. The subsequent connections are numbered 877, 879, 881, 883, 885, and 887. Each of the seven connections 875 through 877 is connected to one of the 42 product lines 830 of FIG. 7*a* so that one of seven prices settable by the switch modules 835 through 847 of FIG. 7*b* may be assigned to any one of the 42 product lines 830. The purpose of the diode modules 855 through 867 is merely to insure that only the correct price is read out on the parallel price bus 850.

If it were not for the presence of the diode modules 855 through 867, a price selected by applying a voltage from a selected line from a group of lines 830 to one of the connections 875 through 887 might appear on more of the lines of the parallel price bus 850 than would be desired due to the common connection at the points 875 through 887 of the elements of the 8-bit parallel price bus 851 through the switch modules 835 through 847.

FIG. 7*c*, an extension of FIG. 7*b* has five additional switch modules 905, 907, 909, 911 and 913 connected to five additional diode modules 915, 917, 919, 921, 923. The five diode modules 915 through 923 each are connected as the previous group of seven diode modules 855 through 867 was connected. Each of the diode modules 855 through 923 has an output connection 925, 927, 929, 931, and 933, respectively, which may be connected to one of 42 product lines 830 from FIG. 7*a*.

The eight-bit parallel price bus 851 is gated through a pair of tristate buffer chips 835, 840 onto the eight-bit buffered data 730. The buffer chips 935, 940 correspond to the price buffer 540 of FIG. 4*a*. The tri-state buffer chips 935, 940 are gated by a set of address signals 945 selected from the address signals 699' of FIG. 6*a*.

When the processor 450 desires to access a previously stored price for a product selected through the keyboard 90, an address associated with that particular product between OO and FF is generated. That address is supplied to the one of 42 decoder 510 which corresponds to the three gated 4 to 16 line decoders 800, 805 and 810. The address is supplied along the 6 bits 820 of the buffered address bus 735. In addition, selected address signals are supplied along the line 825 from the address signals 699' of FIG. 6a. Each of the 42 products has a unique address or indicia which will be sensed and properly decoded by one of the three 4to 16 line decoders 800, 805 and 810. As a result, one of the lines 830 will exhibit a short circuit to system logic ground corresponding to the product address of the selected product. The grounded one line of the set 830 will in turn force a low voltage on one of the common diode points 875 through 887 of FIG. 7b or 825 through 833 of FIG. 7c. Whichever of the above noted common diode point the selected line of the group 830 is connected to effectively selects one of the price switch modules 835 through 847 or 905 through 913. Selecting one of the price switch modules causes the parallel price bus 851 to assume a predetermined state having some combination of ones and zeros. The exact combination which appears on the price bus 851 is determined by which of the switch modules 835 through 847 or 905 through 913 is selected and further what the exact switch settings are in the given switch module. A selected price which appears on the parallel price bus 851 is then gated through the price buffer 540 corresponding to the two chips 935 and 940 onto the 8-bit buffer data bus 730 and then read by the central processing unit 450.

In summary, the process of determining a predetermed price for a selected product involves first the central processing unit 450 generating an indicia associated uniquiely with the selected product, having that indicia decoded uniquely into one of 42 lines in the decoder of FIG. 7a utilizing one of the selected 42 lines to select one of 12 price select switches in FIGS. 7b and 7c, and then gating the selected price through a price buffer 935, 940 of FIG. 7c onto the buffer data bus where it can be acquired by the central processing unit 450.

Figure 8A:
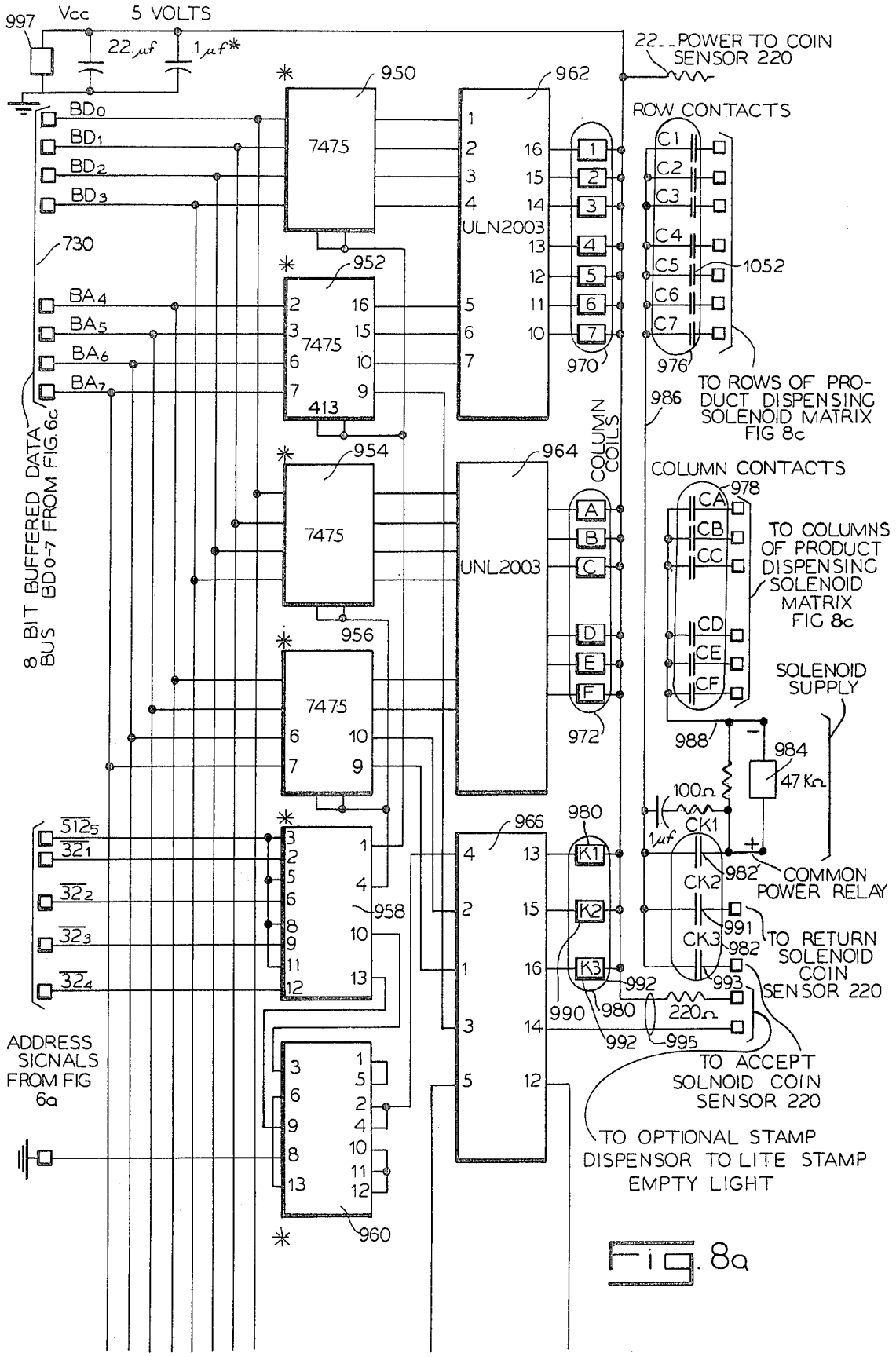
FIGS. 8a, 8b and 8c comprise a schematic diagram of the output board.
Figure 8B:
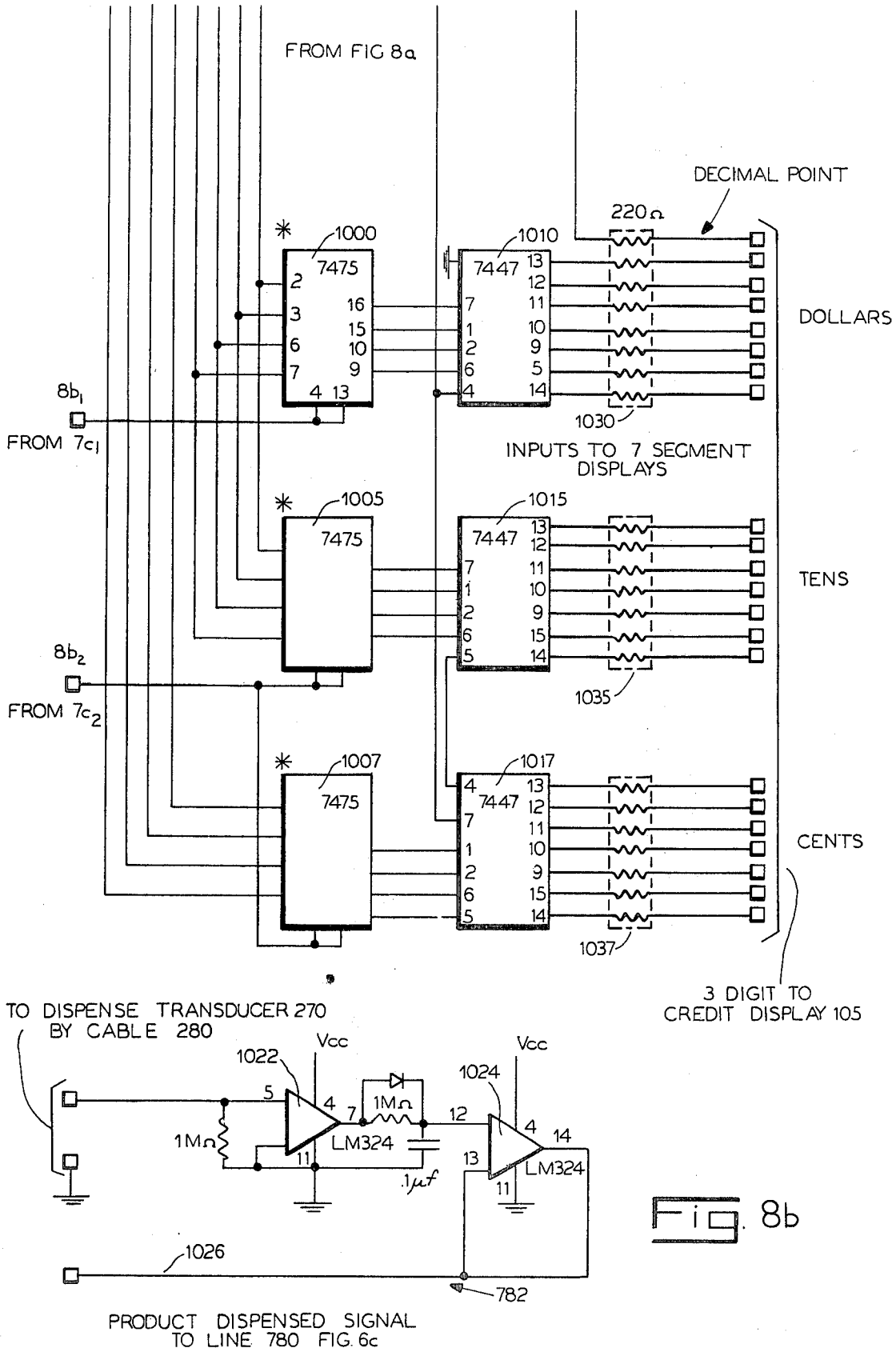
Figure 8C:
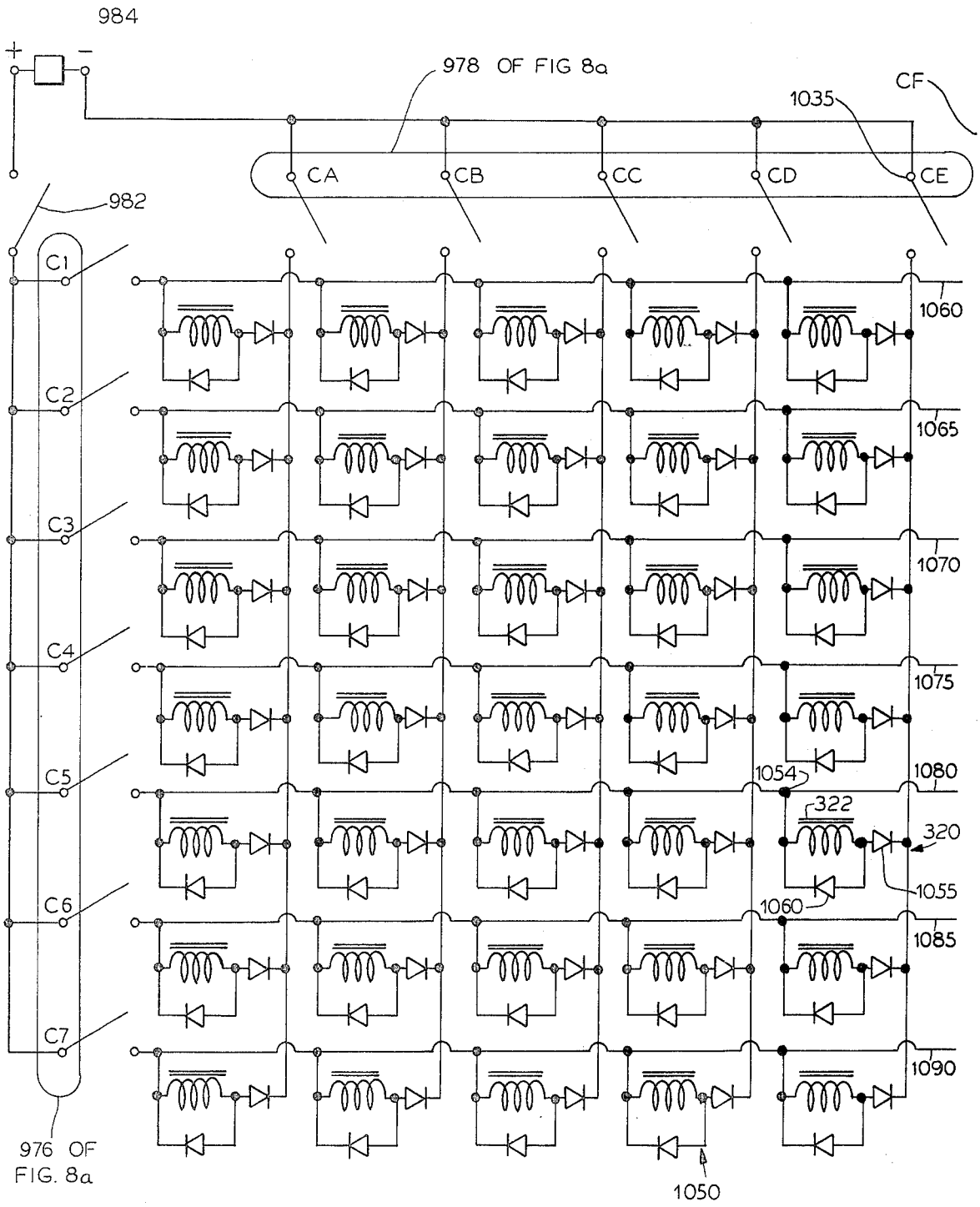

FIG. 8 is a schematic diagram of the output circuitry of the vending machine 10 which is shown in block diagram form in FIG. 4b. FIG. 8a has a set of 4-bit flip-flop latches utilized as output registers 950, 952, 954, 956. Each of the pins of register 952 has been indicated. Pins 2, 3, 6 and 7 represent data inputs to each of the 4 latches in element 952. Inputs 4 and 13 represent clock inputs. Pins 16, 15, 10 and 9 represent flip-flop outputs corresponding to each of the inputs 2, 3, 6 and 7. Elements 950, 954, 956 have the same pin configuration as element 952 so they have not been marked. FIG. 8a also has a pair of two input NOR-gate chips 958 and 960 which are used for generating clock signals for the latches 950, 952, 954 and 956. A set of reed relay drivers 962, 964, and 966 is connected so as to receive inputs from registers 950 through 956 as well as NOR-gate 960. Reed relay drivers 962 and 964 have the same pin configuration. As a result, only the pin configuration for 962 is indicated. Each of the 7 outputs of reed relay driver 962 is connected to a coil of a reed relay. The group of 7 reed relays connected to the reed relay driver 962 is represented by group element 970. Similarly a set of 6 reed relay control coils 972 is connected to the reed relay driver 964. The set of reed relay control coils 970 has a corresponding set of contacts 976 which are normally open and which are closed when each of the coils 970 is energized by the reed relay driver 962. Similarly, each of the control coils 972 has a corresponding, normally open, set of contacts 978 which are closed by the reed relay driver 964 energizing the control coils 972. Three of the outputs from reed relay driver 966 are connected to a set of coils 980. The set of control coils 980 has a corresponding set of normally open contacts 982 which are closed by the reed relay driver 966 energizing the control coils 980. Each of the reed relays represented by the coil and contact sets 970, 976; 972, 978; and 980, 982 can be Elec-trol part type RA 31441051 or equivalent. The group of reed relay control coils 970, whose corresponding set of contacts is 976 is used to select a row of a product dispensing solenoid matrix. The product dispensing solenoid matrix, a schematic of which is shown in FIG. 8c will be discussed subsequently. Each of the reed relay coils 972, having an associated set of contacts 978 is used to select a column in the product dispensing solenoid matrix disclosed in FIG. 8c.

When the processing unit 450 has detected an equality between the present coin credit accumulated in a memory location in RAM 475 and the prestored product price, the row select register 550 is loaded with a set of 8 bits through the 8-bit buffer data bus 730 which determine which of 7 rows in the product dispensing solenoid matrix the product dispensing solenoid such as the solenoid 320 is located. The row select register 550 corresponds to the two flip-flop latches 950 and 952. The row select reed relays 580 correspond to the coil and contact elements 970 and 976. Similarly, a set of 6 columns is specified in the column select register 555. The column select register 555 corresponds to the flip-flop registers 954 and 956 which are loaded off of the buffered data bus 970. Column coils and associated column contacts 972 and 978 correspond to the column select reed relays 585.

A solenoid such as the solenoid 320 is selected by defining a row, one of seven in the product dispensing solenoid matrix of FIG. 8c and a column, one of six of the product dispensing solenoid matrix of FIG. 8c. Once a solenoid has been selected, the common control relay register 565 is set thereby closing the common control relay 595 and applying power to the selected solenoid. Selected elements of the address signals 699' which provide inputs to the NOR-gate 958 and 960 are decoded so as to provide an input to reed relay driver 966 which in turn energizes a coil 980. This is the control coil for the common control relay 595. A set of contacts 982' is closed by the coil 980 thereby providing power from a solenoid power supply of a convention type 984 along a line 986 to one side of each of the contacts 976. The contacts 976 being the row contacts associated with the product dispensing solenoid matrix of FIG. 8c. One side of each of the column contacts 978 is connected to a common line 988 which is in turn connected to the low voltage side of the power supply 984. Thus, first a row of the product dispensing solenoid matrix of FIG. 8c is selected by means of the row coils 970, then a column of the product dispensing solenoid matrix of FIG. 8c is selected by means of the column coils 972. Finally, power is supplied to the row contacts 976 by closure of the common power relay control coil 980 which in turn closes its associated contact 982'. The solenoid power supply 984 is impressed across the rows of the product dispensing solenoid matrix of FIG. 8c but current flows only through the closed one of the row contacts 976, through the selected solenoid such as the solenoid 320, through the selected one of the column contacts 978 and then back into the solenoid power supply 984 on the line 988. The closure of the selected solenoid such as the solenoid 320 then operates the product dispensing mechanism 310 as previously discussed.

The accept and return register 560 corresponds to the two flip-flop latches in the register element 956 having input pin designations 6, 7 and output pin designations 10, 9. The output pins 10, 9 of element 956 which are connected to input pins 2, 1 of reed relay driver 966 permit the controlled energization of reed relay control coils 990, 992, corresponding to the accept and return reed relays 590. Control coil 990 has an associated set of normally open contacts 991 and control coil 992 has a set of normally open control contacts 993. Both the contacts 991 and 993 are closed before the contacts 982' of the common power relay are closed. Power supplied from the solenoid power supply 984 through the common power relay 982 may be supplied to the return solenoid of the coin sensor 220 through the set of contacts 991. Similarly, power from the solenoid power supply 984 may be supplied to the accept solenoid of the coin sensor 220 through the contacts 993.

A pair of lines 995 connected to reed relay driver 966 may be used in conjunction with the optional stamp dispenser 40 to light a stamp empty light. A low voltage power supply 997 is also shown on FIG. 8*a* and provides nominally 5 volts to all of the electronic circuits utilized in the control system for the vending machine 10.

FIG. 7*b* shows an additional set of three 4-bit flip-flop output registers 1000, 1005, 1007 connected to a set of three binary coded decimal to 7 segment decoders 1010, 1015, and 1017. The analogue circuit 782 composed of a pair of operational amplifiers 1022 and 1024 is provided to convert the signal from the dispense transducer or microphone 270, by a cable 280 into a compatible logic signal on a line 1026 to provide a product dispensed signal to line 770 of FIG. 6*c*.

The dollars register 570 of FIG. 4*a* corresponds to the 4-bit flip-flop output register 1000 of FIG. 8*b*. The cents register 575 of FIG. 4*a* corresponds to the pair of 4-bit flip-flop output registers 1005 and 1007 of FIG. 8*b*. The BCD to 7 segment decoders 600, 605 corresponds to the three BCD 7 segment decoders 1010, 1015, and 1017 of FIG. 8*b*. The 7 segment outputs of the converters 1010 through 1017 each pass through a set of current limiting resistors 1030, 1035 and 1037 prior to being connected to the three-digit credit display 105.

The analogue signal generated by the dispense transducer or microphone 270 affixed to the product dispensing plate 130 travels along the cable 280 to the operational amplifier 1022 and the subsequent operational amplifier 1024 wherein it is processed and converted to a 5 volt signal compatable with the integrated circuits used in the digital electronic control on the line 1026.

FIG. 8*c* is a schematic of a product dispensing solenoid matrix 1050. The matrix 1050 has 7 rows by 6 columns corresponding to a total of 42 different product dispensing solenoids. Since the solenoid 320 is typical of all of the product dispensing solenoids a discussion of its electrical operation will apply equally to the other 41. The solenoid 320 is selected by closing a contact 1052, one of the group of row contacts 976 and a column contact 1053 one of the group of column contacts 978. With the contact 1052 and the contact 1053 closed, assuming the contact 982 has been closed, a positive voltage will be applied to a point 1054, through the electrical coil 322 causing a diode 1055 to conduct which results in a current flow through the switch 1052, through the point 1054 through the coil 322 through the diode 1055 through the column switch 1053 and into the negative side of the solenoid supply 984. This current flow results in the leaf spring 325 of the solenoid 320 being deflected thereby rotating the dispensing mechanism 310 and dispensing a product 360. A suppressor diode 1060 is connected across the coil 322 to suppress transients generated when the contact 982 is opened. The diode 1055 insures that the coil 322 and the suppressor diode 1060 present an open circuit in the matrix except when the switch 1052 and the switch 1053 are closed.

It should be noted that for purposes of accessing a depressed key on the keyboard 90 the central processing unit 450 sequentially addresses each of the 6 columns on the keyboard 90 by means of the output buffer 755 and set of 6 lines 797. As each column is addressed, a signal is received on each of the lines of group element 790 from the 7 rows of keys on the keyboard 90. The lines 790 provide inputs to the input buffer 750 which in turn makes the state of each of the 7 rows available to the buffered data bus 730, the 8-bit bidirectional data bus 455 and then to the processor 450.

Each of the output registers the row select register 550 the column select register 555 the accept and return register 560 the common control relay register 565 the dollars register 570 and the cents register 575 all receive address signals from selected lines of the address signal 699' and, where necessary, signals from the buffered address bus 690. Each of the above enumerated registers then receives data from the buffered data bus 730 in conjunction with the noted address signals.

The product dispensing matrix, FIG. 8*c*, is shown in detail for a 5 row×7 column matrix column. CF is indicated as being attached to a set of row lines 100–1090. Column CF is identical in construction to columns CA-CD. The matrix of FIG. 8*c* may be expanded beyond 42 positions merely by adding additional columns such as column CF to the lines 1000–1090.

Each of the electronic elements has a type number associated with it for identification purposes. Any equivalent integrated circuit may be used in lieu of the specified type provided it is a plug compatable electronic equivalent. Further identification and information concerning the integrated circuits used herein may be found in the literature of the art such as a book published by Texas Instruments Inc. entitled "TTL Data Book for Design Engineers" second edition, copyright 1976. Information concerning the central processing unit the National Semiconductor ISP-8A/500D single chip microprocessor (SC/MP) may be found in a National Semiconductor preliminary data sheet of April 1976 bearing a designation DA-B20N46.

Although various modifications might be suggested by those skilled in the art, it should be understood that I wish to embody within the scope of the patent warranted hereon all such modifications as reasonably and properly come within the scope of my contribution to the art.

I claim as my invention:

1. A vending machine for dispensing a plurality of products comprising, a frame having a product delivery plate mounted thereon, a plurality of product dispensing racks supported by said frame, each member of said plurality having an associated means for dispensing, one at a time, a product stored on the said rack, a coin sensing mechanism, a coin box affixed to said coin sensing mechanism, means for selecting one of the plurality of product dispensing racks for dispensing a selected product, means affixed to said product delivery plate for detecting the impact of one of the selected product against said product delivery plate, control means for receiving signals from said coin sensing mechanism and accumulating a current total in a selected memory location, including means for sensing an output from said means for selecting defining a selected one of the plurality of products to be dispensed, reading a pre-stored price corresponding to the selected product, comparing the accumulated total in said selected memory location to the pre-stored price of the selected product, activating a selected one of said means for dispensing associated with a selected member of said plurality of dispensing racks to dispense one of the selected product if the contents of said selected memory location equals to the pre-stored price of the selected product and sensing whether one of the selected product has been dispensed by sensing a signal from said means for detecting the impact of one of the selected product against said product delivery plate.

2. The vending machine according to claim 1, wherein said means for detecting an impact comprises a transducer affixed to said product delivery plate capable of detecting vibrations created by the selected, dispensed, product striking said product delivery plate.

3. The vending machine according to claim 2, wherein each of said means for dispensing associated with each member of said plurality of product dispensing racks comprises:

a solenoid having a coil and a member capable of limited movement in response to said coil receiving a predetermined current, a dispenser having a central member rotatably mounted on said means for dispensing, an actuating member affixed to said central member, a first and a second spaced apart elongated member each connected at a first end to said central member, a bracket having a first and a second end with said first end being attached to said first elongated member and said second end being rotatably attached to said associated product dispensing rack, whereby when said coil is energized, said member capable of limited motion displaces said actuating member rotating said central member and said first and second elongated members with said first member thereby releasing one of a selected product to be dispensed and with said second member thereby being capable of blocking at least one additional of the selected product from being dispensed.

4. The vending machine according to claim 3, wherein said control means includes a bidirectional data bus operably connected to an output register; said output register having a series of flip-flops, at least some of said flip-flops being connected to means for actuating at least some of said solenoids associated with said members of said plurality of dispensing racks.

5. The vending machine according to claim 3, wherein said solenoids are connected to form a matrix with the said solenoid associated with the said tray supporting a selected product, one of which is to be dispensed, being selected by means for selection operable for selecting a row and a column of said matrix whose intersection corresponds to the location of said solenoid in said matrix.

6. The vending machine according to claim 5 having further:

means for supplying an electrical current to a said selected solenoid after said solenoid has been selected by said means for selection.

7. The vending machine according to claim 1, wherein said means for reading a pre-stored price comprises:

means for sensing an indicia associated with a selected product and generating a signal on a selected one of a plurality of lines wherein said plurality of lines has a member associated with each selectable product, means for converting the signal on said selected line to a bit pattern representing a price associated with the selected product including manually settable price select switches and a price data bus.

8. A vending machine for dispensing a plurality of products comprising:

a supporting frame, a product delivery plate affixed to said frame, a plurality of product dispensing racks supported by said frame, each member of said plurality of product dispensing racks having means for dispensing connected to said member comprising;

a solenoid, a member capable of limited movement under the control of said solenoid, a dispenser having;

a body member, an actuating member affixed to said body member, a first and a second spaced apart elongated member each affixed at a first end to said body member, said dispenser being capable of limited movement in a selected direction and supported by an elongated supporting member operatively affixed to said member of said plurality of product dispensing racks, a coin sensing mechanism affixed to said frame and having a port for the receipt of coins, a coin box affixed to said coin sensing mechanism, means for selecting one of the plurality of products, a transducer affixed to said product delivery plate operable to detect the impact of one of the selected product against said product delivery plate, means for control comprising an input buffer capable of receiving a signal from said coin sensing mechanism indicating that a coin of a selected value has been deposited into said port, a first memory capable of temporarily storing a value representing an accumulated current credit based on the coins deposited into said port, an accumulator connected to said input buffer and said memory capable of accumulating a current credit based on the value of the latest coin deposited in said port and the previous credit stored in said first memory, a price storage circuit capable of storing a plurality of manually settable, preselected prices one of which may be associated with each member of the plurality of available products, said price storage circuit having an input port capable of receiving an indicia associated with a selected product and an output port controlably connected to said accumulator whereat the prestored price associated with the received indicia of the selected product may be sensed by said accumulator comparison and control circuitry operable to compare the prestored price associated with the selected product to the current credit and to generate an indicia of equality of the two values are equal, circuitry connected to said comparison and control circuitry for sensing the indicia of equality and for energizing a said means for dispensing associated with a said member of said plurality of product dispensing racks thereby releasing one of the selected product, analogue circuitry operable to receive an electrical signal from said transducer indicating that the dispensed one of the selected product has impacted against said product delivery plate and for generating a signal receivable by said input buffer and detectably by said comparison and control circuitry, said control circuitry including further means to signal said coin sensing mechanism to deposit the collected coins in said coin box.

9. The vending machine according to claim 8 wherein said dispenser has additionally a reinforcing member connecting said first elongated member with said elongated supporting member.

10. The vending machine according to claim 8 wherein said transducer comprises a loudspeaker operably affixed to said product dispensing plate.

11. The vending machine according to claim 8 wherein said transducer comprises a microphone operably affixed to said product dispensing plate.

12. The vending machine according to claim 9 wherein:

said solenoids associated with each said member of said plurality of dispensing racks are operably connected in a matrix.

13. The vending machine according to claim 9 wherein said means for selecting comprise:

a keyboard with a plurality of keys connected to keyboard interface circuitry, said keyboard interface circuitry being capable of receiving control signals from said control circuitry and capable of transmitting a controlled sequence indicating which member of said plurality of keys has been depressed thereby selecting a product.

14. The vending machine according to claim 8 wherein said price storage circuit comprises:

a decoder circuit connected to said input port and having a a first plurality of output lines, each member of said plurality of output lines being associated with a selectable product, means for connecting whereon each said member of said first plurality of lines may be manually associated with a member of a second plurality of lines where said first plurality has at least as many members as does said second plurality, a set of manually settable price select means for switching, each member of said set being operably connected at a first end to a said member of said second plurality of lines, and corresponding switches in each said means for switching being connected together to form a parallel price bus operably connected to said output port.

15. The vending machine according to claim 8 wherein said analogue circuitry comprises a first and a second operational amplifier operably connected.

16. An improved dispenser mechanism for use with a dispensing tray in a vending machine having a central member with a boring therethrough, an actuating arm affixed to said central member, a first and a second elongated, spaced apart, member each attached at a first end to said central member, the central member receiving a supporting member through the boring therein, the improvement comprising:

a reinforcing bracket having a first and a second end, said first end being affixed to said first elongated member, said second end having a boring capable of receiving the supporting member therethrough.

* * * * *